US010059019B2

(12) United States Patent
Klockow et al.

(10) Patent No.: US 10,059,019 B2
(45) **Date of Patent: *Aug. 28, 2018**

(54) APPARATUS FOR CUTTING FOOD PRODUCT AND METHOD OF USE THEREOF

(75) Inventors: Scott Alan Klockow, Kouts, IN (US); Michael Scot Jacko, Westville, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 691 days.

This patent is subject to a terminal disclaimer.

(21) Appl. No.: 12/761,883

(22) Filed: Apr. 16, 2010

(65) Prior Publication Data

US 2010/0263510 A1 Oct. 21, 2010

Related U.S. Application Data

(60) Provisional application No. 61/170,136, filed on Apr. 17, 2009.

(51) Int. Cl.
*B26D 1/03* (2006.01)
*B26D 3/18* (2006.01)
(Continued)

(52) U.S. Cl.
CPC ..... *B26D 7/0691* (2013.01); *B26D 1/02* (2013.01); *B26D 1/03* (2013.01); *B26D 1/143* (2013.01);
(Continued)

(58) Field of Classification Search
CPC . B26D 1/02; B26D 1/143; B26D 1/36; B26D 3/18; B26D 3/22; B26D 3/28;
(Continued)

(56) References Cited

U.S. PATENT DOCUMENTS 1,777,384 A * 10/1930 Smith ..... 99/636
2,004,548 A * 6/1935 Abbott ..... B26D 1/553 83/404.3
(Continued)

FOREIGN PATENT DOCUMENTS

FR 1.243.301 * 8/1960 ..... B26D 1/03

*Primary Examiner* — Clark F Dexter
(74) *Attorney, Agent, or Firm* — Hartman Global IP Law; Gary M. Hartman; Domenica N. S. Hartman

(57) ABSTRACT

Method and apparatus for reducing food products. The apparatus includes a casing, an impeller adapted for rotation within the casing, and a cutting device. The casing has axial and circumferential openings for product entering and exiting, respectively, the casing. The impeller includes a drum, paddles mounted to the drum, and pockets defined by and between adjacent pairs of paddles that are radially aligned with the circumferential opening of the casing as each pocket travels past the circumferential opening. The cutting device includes a knife disposed at the circumferential opening of the casing and oriented perpendicular to the axis of the impeller. The knife lies on a sector of the casing and has a cutting edge located within an interior of the casing so that the knife extends into the path of the paddles and passes through relief slots defined in the paddles as the impeller rotates.

19 Claims, 3 Drawing Sheets

(51) Int. Cl.

| | |
|---|---|
| ***B26D 3/30*** | (2006.01) |
| ***B26D 7/06*** | (2006.01) |
| ***B26D 1/02*** | (2006.01) |
| ***B26D 1/143*** | (2006.01) |
| ***B26D 1/36*** | (2006.01) |
| ***B26D 3/22*** | (2006.01) |
| ***B26D 3/28*** | (2006.01) |

(52) U.S. Cl.
CPC ..... *B26D 1/36* (2013.01); *B26D 3/18* (2013.01); *B26D 3/22* (2013.01); *B26D 3/28* (2013.01); *B26D 3/30* (2013.01); *B26D 7/06* (2013.01); *B26D 2210/02* (2013.01); *Y10S 83/932* (2013.01); *Y10T 83/04* (2015.04); *Y10T 83/2209* (2015.04); *Y10T 83/6473* (2015.04); *Y10T 83/6481* (2015.04); *Y10T 83/6491* (2015.04); *Y10T 83/6667* (2015.04)

(58) Field of Classification Search
CPC ..... B26D 3/30; B26D 7/06; B26D 7/0691; B26D 2210/02; B26D 1/03; B26D 3/185; B26D 7/0608; Y10S 83/932; Y10T 83/2209; Y10T 83/6473; Y10T 83/6476; Y10T 83/6478; Y10T 83/6481; Y10T 83/6489; Y10T 83/6491; Y10T 83/6492; Y10T 83/6545; Y10T 83/6547; Y10T 83/6548; Y10T 83/6558; Y10T 83/6571; Y10T 83/6667
USPC ... 83/403, 932, 162, 404, 404.1, 404.3, 407, 83/408, 410, 410.7, 410.8, 411.5, 417, 83/703, 733
See application file for complete search history.

(56) References Cited

U.S. PATENT DOCUMENTS

| | | | | |
|---|---|---|---|---|
| 2,485,344 | A * | 10/1949 | Abbott | B26D 1/03 83/112 |
| 2,539,002 | A * | 1/1951 | Abbott | B26D 3/18 83/162 |
| 2,545,720 | A * | 3/1951 | Abbott | B26D 3/185 83/403 |
| 3,472,297 | A | 10/1969 | Urschel et al. | |
| 3,521,688 | A | 7/1970 | Urschel et al. | |
| 3,857,310 | A * | 12/1974 | Tiby | B26D 1/25 209/638 |
| 4,604,925 | A | 8/1986 | Wisdom | |
| 5,238,121 | A * | 8/1993 | Frisbie | 209/539 |
| 6,314,849 | B1 * | 11/2001 | Arrasmith | B26D 3/22 241/166 |
| 6,460,444 | B2 | 10/2002 | Jacko | |
| 6,736,041 | B2 * | 5/2004 | Portnoy | 83/404.1 |
| 6,748,837 | B2 * | 6/2004 | Benjamin et al. | 83/435.2 |
| 6,883,411 | B2 | 4/2005 | Arrasmith et al. | |
| 7,658,133 | B2 | 2/2010 | Jacko et al. | |
| 2002/0029673 | A1 * | 3/2002 | Arrasmith | B26D 3/22 83/145 |
| 2002/0144584 | A1 * | 10/2002 | Arrasmith et al. | B26D 1/02 83/663 |
| 2002/0166431 | A1 * | 11/2002 | Benjamin et al. | 83/423 |
| 2007/0240550 | A1 | 10/2007 | Jacko et al. | |

* cited by examiner

APPARATUS FOR CUTTING FOOD PRODUCT AND METHOD OF USE THEREOF

CROSS REFERENCE TO RELATED APPLICATIONS

This application claims the benefit of U.S. Provisional Application No. 61/170,136, filed Apr. 17, 2009, the contents of which are incorporated herein by reference.

BACKGROUND OF THE INVENTION

The present invention generally relates to methods and equipment for cutting food product.

Various types of equipment are known for slicing, dicing, shredding and granulating food products. A particular example is the DiversaCut 2110® manufactured by Urschel Laboratories, aspects of which are disclosed in patent documents including U.S. Pat. Nos. 3,472,297 and 3,521,688. The DiversaCut 2110® is adapted to uniformly slice, strip cut, and/or dice a wide variety of vegetables, fruits, and meat products at high production capacities. A portion of a DiversaCut model is depicted in FIG. 1 as an apparatus 10 comprising a casing 12 that encloses an impeller assembly 14. Food product 16 is delivered through a feed hopper (not shown) to the impeller assembly 14 as the impeller assembly 14 rotates on a horizontal axis within the casing 12. Centrifugal force holds the product 16 against the inner wall of the casing 12 as paddles 20 of the impeller assembly 14 carry the product 16 past a slicing knife 22 mounted on the casing 12 and oriented roughly parallel to the axis of the impeller assembly 14. The product 16 moves outward across the edge of the slicing knife 22 to produce a single slice from each individual product 16 with each rotation of the impeller assembly 14. In the embodiment shown, the slices enter circular knives 24 as they radially emerge from the slicing knife 22, with the result that the slices are cut into strips 26 as the slices continue to travel under the momentum originally induced by the impeller assembly 14. The strips 26 then pass directly into a rotating knife assembly 28 equipped with crosscut knives that make a transverse cut to produce diced product 30, which is then discharged from the apparatus 10 through a discharge chute 32.

As evident from FIG. 1, the circular knives 24 are located entirely outside the casing 12 and impeller assembly 14, and therefore engage the food product 16 only after the product 16 has left the paddles 20 and slices cut therefrom have been produced by the slicing knife 22. While the arrangement works well for processes in which slicing is the first operation performed on a food product 16 and each product 16 is gradually sliced over the course of multiple rotations of the impeller assembly 14, this arrangement is not adapted for processes in which individual food products are desired to undergo a halving operation, in which products are cut once and then expelled during a single rotation of the impeller assembly 14.

BRIEF DESCRIPTION OF THE INVENTION

The present invention provides a methods and equipment suitable for performing halving operations and similar cutting operations on food products.

According to a first aspect of the invention, the apparatus includes a casing, an impeller adapted for rotation within the casing about an axis of symmetry thereof, and a cutting device. The casing comprising a stationary housing, an axial opening sized to accommodate food product entering the casing, and a circumferential opening sized to accommodate food product exiting the casing. The impeller comprises a drum, paddles mounted to the drum, and pockets defined by and between adjacent pairs of the paddles. The drum has an axial opening coinciding with the axial opening of the casing to define an inlet through which food product enters the impeller. The paddles are circumferentially spaced along a perimeter of the drum so that each pocket is radially aligned with the circumferential opening of the casing as the pocket travels past the circumferential opening of the casing. Each paddle has a relief slot defined in an outer radial edge thereof. The cutting device comprises at least one knife disposed at the circumferential opening of the casing and oriented perpendicular to the axis of the impeller. The knife lies on a sector of the casing and has a cutting edge located within an interior of the casing so that the knife extends into the path of the paddles and passes through the relief slots of the paddles as the impeller rotates and the paddles pass across the circumferential opening in the casing.

Additional aspects of the invention include method of using the apparatus to reducing the size of food product.

In view of the above, food product introduced into the impeller is cut with the knife during rotation of the impeller, and during which the knife extends into the path of the paddles and passes through the relief slots of the paddles as the paddles pass across the circumferential opening in the casing. In this manner, an entire individual food product can be cut (for example, halved) and expelled from the casing during a single rotation of the impeller. Following the cut made by the knife as the food product leaves the impeller, the apparatus can be configured to perform additional operations on the product, including additional dicing, shredding and/or granulating operations.

Other aspects and advantages of this invention will be better appreciated from the following detailed description.

DETAILED DESCRIPTION OF THE INVENTION

Figure 1:
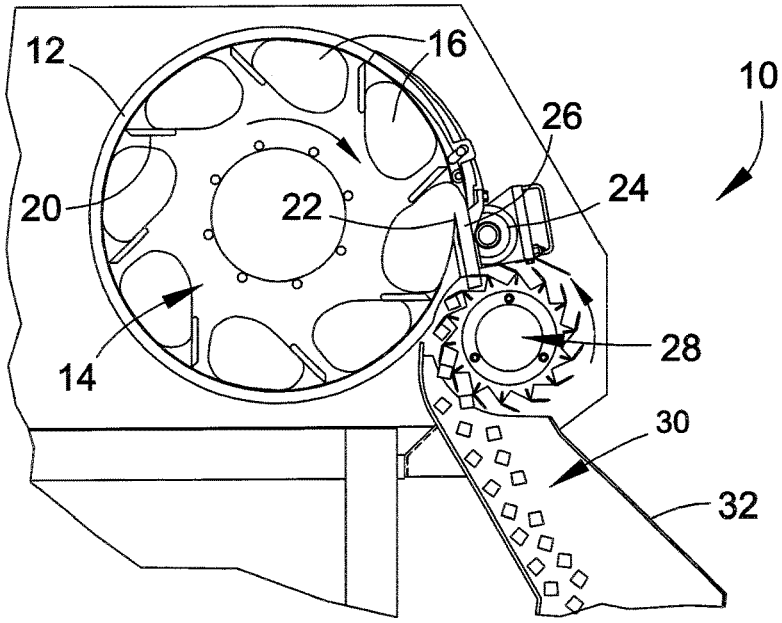
FIG.1 Prior Art
FIG. 1 is a fragmentary view of a machine adapted for slicing, dicing, shredding and/or granulating food products in accordance with the prior art.
Figure 2:
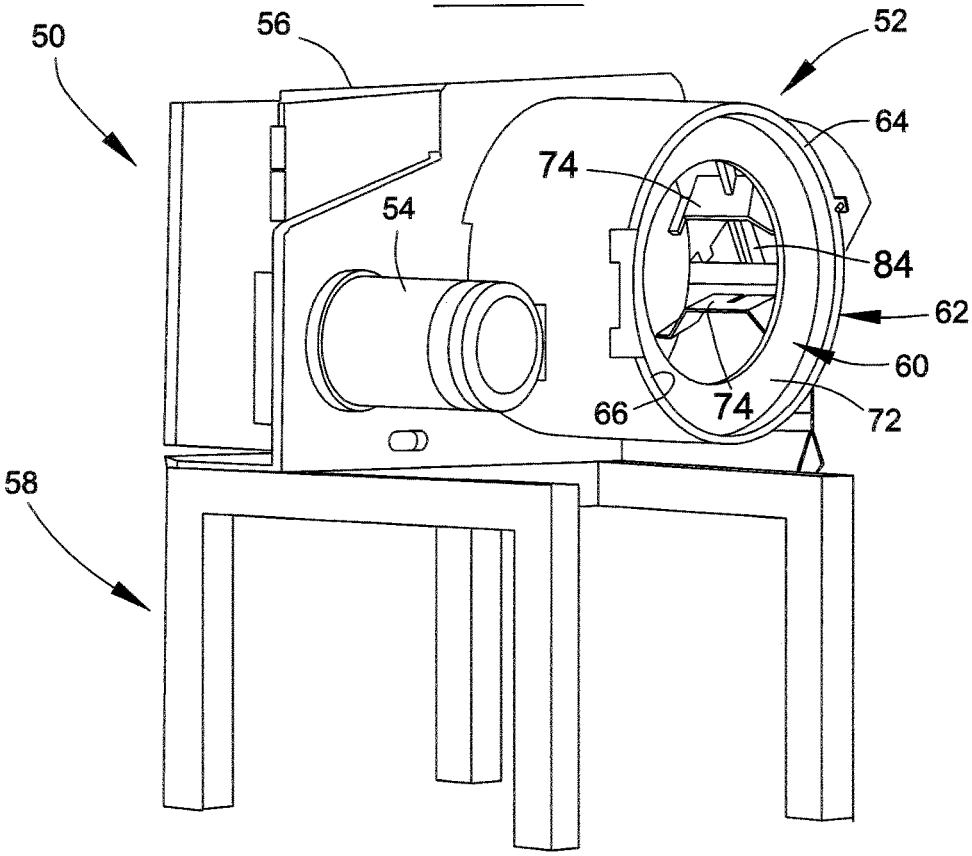
FIG. 2 depicts a machine adapted for cutting food product in accordance with an embodiment of this invention.
Figure 3:
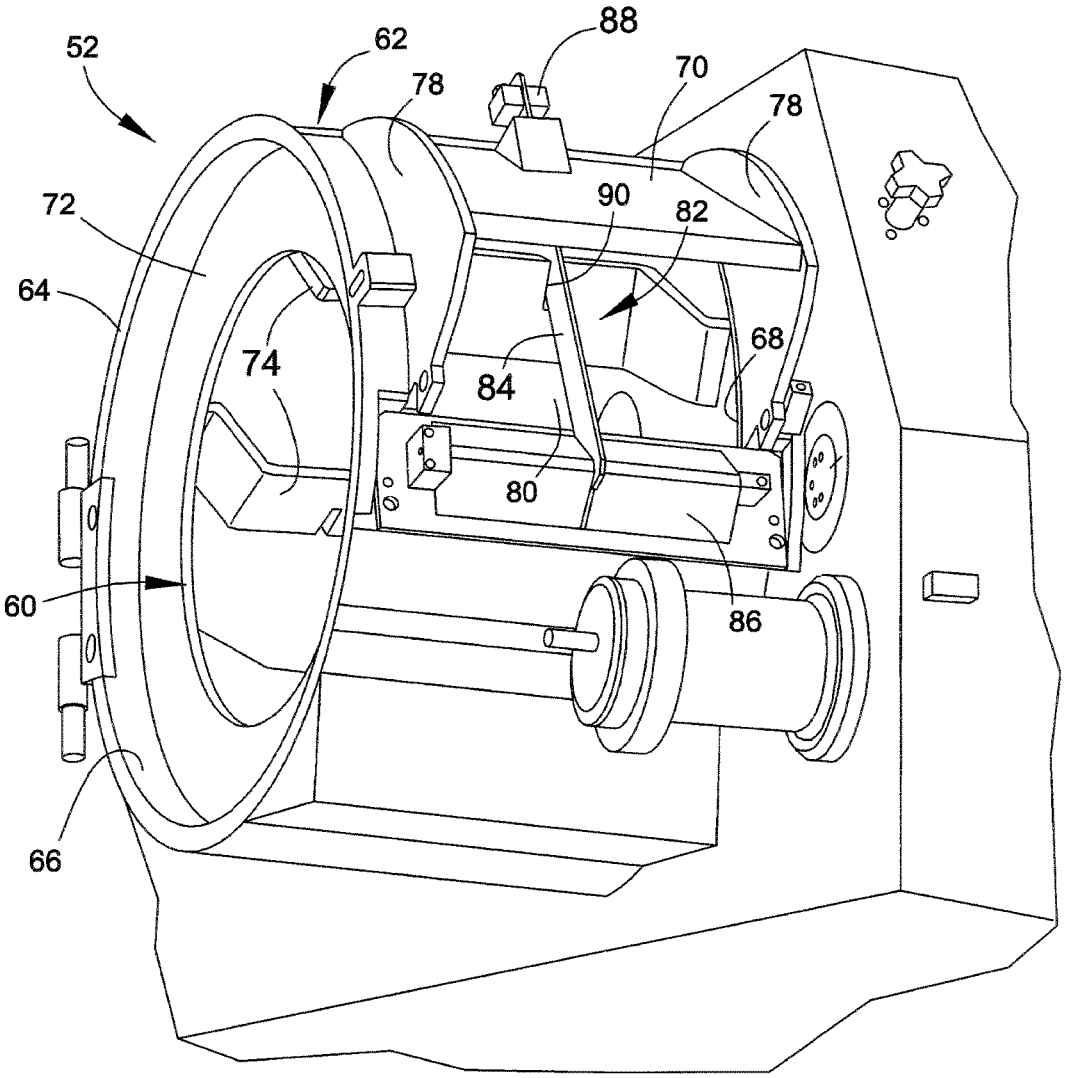
FIGS. 3 and 4 are perspective and cross-sectional views, respectively, of an impeller section of the machine of FIG. 2.
Figure 4:
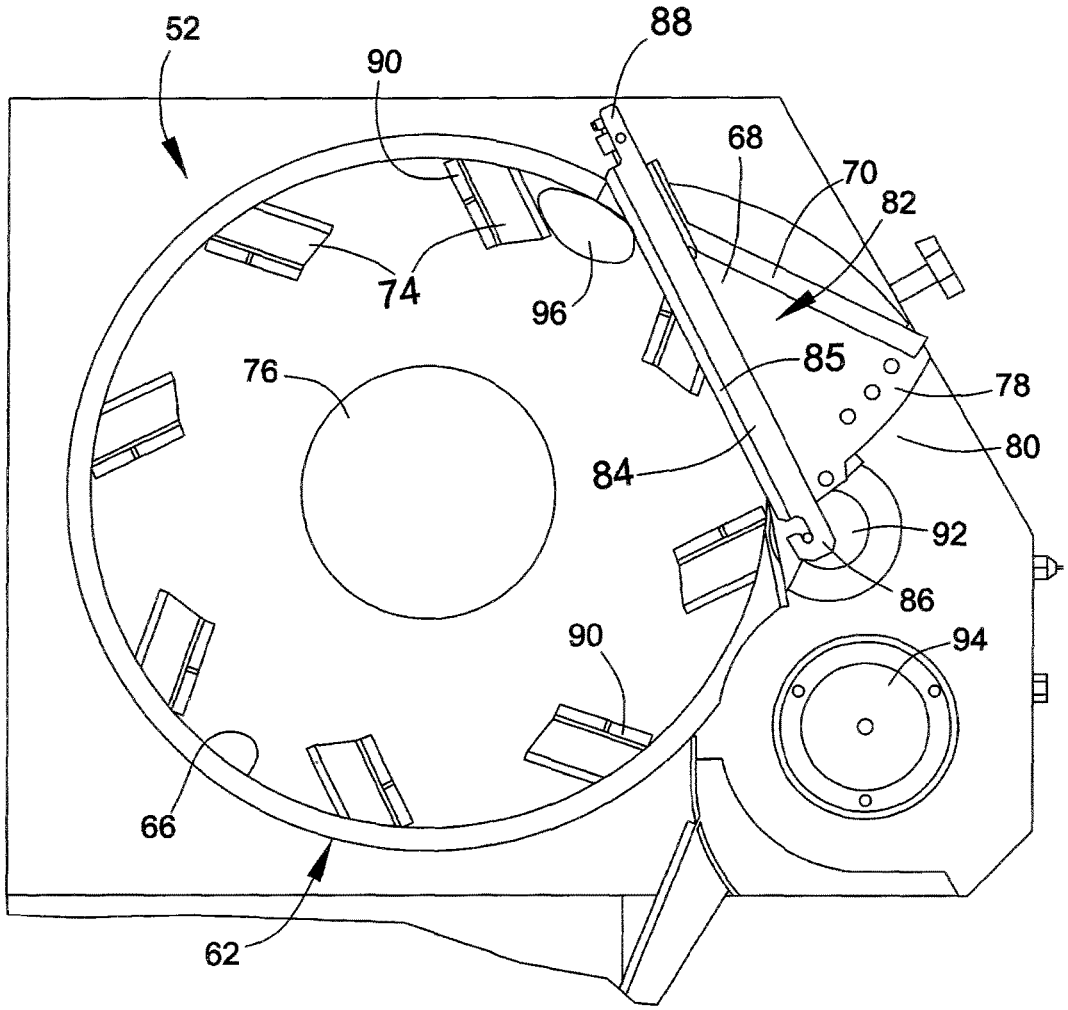

FIGS. 2 through 4 depict an apparatus 50 configured to initially perform a single-cut operation, such as a halving operation, on food products. The apparatus 50 comprises a casing-impeller assembly 52, an electric motor 54, a drive housing 56, and a frame 58 that supports the apparatus 50. The motor 54 powers a drive assembly (not shown) within the drive housing 56, which in turn drives an impeller assembly 60 of the casing-impeller assembly 52, as will be discussed in more detail below. The apparatus 50 is similar to the DiversaCut 2110® model represented in FIG. 1, and as such preferred embodiments of the apparatus 50 would further include a hopper (not shown) for delivering food product to the casing-impeller assembly 52 and a discharge chute (not shown) through which processed food product is discharged from the casing-impeller assembly 52, consistent with the previous description of FIG. 1.

The casing-impeller assembly 52 is the operative section of the apparatus 50 for reducing the size of food product. As more particularly evident from FIGS. 3 and 4, the casing-impeller assembly 52 comprises the aforementioned impeller assembly 60, which is enclosed and coaxially mounted for rotation within an annular-shaped casing 62 that defines a stationary housing for the impeller assembly 60. Both the impeller assembly 60 and casing 62 have generally cylindrical shapes with coinciding axes. The casing 62 has a circumferential wall 64 that defines an open axial end 66 through which food product is able to enter the impeller assembly 60, and further defines a circumferential opening 68 (FIG. 3) through which food product is able to exit the impeller assembly 60. The circumferential opening 68 is shown in FIGS. 3 and 4 as being closable with a gate 70 mounted to the casing 62. The impeller assembly 60 comprises a drum 72 with an open axial end coinciding with the open axial end 66 of the casing 62, a number of axially-orientated, circumferentially-spaced paddles 74 that are mounted near the perimeter of the drum 72 so as to be adjacent the wall 64 of the casing 62, and a cylindrical or conical cap 76 (FIG. 4) that rotates with the drum 72 and paddles 74 within the casing 62. The circumferential opening 68 and gate 70 of the casing 62 cooperate with a pair of guards 78 to define an outlet 80 of the casing-impeller assembly 52. The size of the outlet 80 is adjustable by pivoting the gate 70 toward and away from the casing 62. With this arrangement, as the impeller assembly 60 rotates in a clockwise direction (as viewed in FIG. 4), pockets defined by and between adjacent pairs of paddles 74 capture food product 96 introduced into the impeller assembly 60 through the open axial end of its drum 72, and centrifugal forces produced by rotation of the impeller assembly 60 cause the product 96 to be urged radially outward into engagement with the casing 62.

Disposed at the outlet 80 is a cutting assembly 82 that includes a knife 84 whose ends are secured between a pair of knife holders 86 and 88 attached to the casing 62. The knife 84 is oriented in a plane perpendicular to the axis of rotation of the impeller assembly 60, and is mounted to lie on a cord of the casing 62 so that a cutting edge 85 of the knife 84 is located within the interior of the casing 62. Because the knife 84 extends into the path of the impeller paddles 74, the paddles 74 are shown as having relief slots 90 in their outer radial edges through which the knife 84 passes as the impeller assembly 60 rotates and the paddles 74 pass across the circumferential opening 68 in the casing 62. The knife 84 is shown in FIGS. 2 through 4 as not passing entirely through the radial extents of the paddles 74, and therefore the relief slots 90 are not required to extend entirely through the paddles 74. However, it is foreseeable that the paddles 74 could be constructed so that each is entirely divided by its relief slot 90 to comprise two paddle portions separated by its slot 90.

In view of the above, as the impeller assembly 60 rotates in a clockwise direction (as viewed in FIG. 4), the paddles 74 effectively push the product 96 through the knife 84 instead of simply propelling the product 96 through the knife 84. After the knife 84 has passed through the product 96, the product 96 is ejected from the casing 62 through the circumferential opening 68 and then exits the apparatus 50 through the outlet 80. As evident from FIG. 4, the knife 84 may be the only cutting element of the cutting assembly 82 and the apparatus 50, or the apparatus 50 may be configured to perform additional processing on the product 96 downstream of the knife 84, such as with circular knives 92, and/or crosscut knives 94 similar to the type employed by the DiversaCut 2110®.

As seen in FIG. 4, the paddles 74 are preferably inclined relative to radials of the impeller assembly 60. A suitable inclination angle is believed to be approximately thirty degrees from a radial of the impeller assembly 60 that passes through an outer radial edge of the paddle 74, with each paddle 74 inclined so that its inner radial edge is circumferentially ahead of its outer radial edge in the direction of impeller rotation. With this orientation, FIG. 4 shows the paddles 74 as roughly parallel to the knife 84 at the moment a food product 96 carried by one of the paddles 74 encounters the knife 84. As also shown in the embodiment of FIG. 4, the paddles 74 are roughly perpendicular to the knife 84 at the moment the paddles 74 have completed their pass across the circumferential opening 68 of the casing 62. FIG. 4 also depicts the circumferential opening 68 in the casing 62 as spanning approximately seventy degrees of the casing circumference, and the portion of the knife 84 that projects into the interior of the casing 62 spans approximately fifty-five degrees of the casing circumference. It should be understood that the angular span of the circumferential opening 68 determines what inclination angle will be necessary to ensure that the paddles 74 will be roughly parallel to the knife 84 at the moment the food product 96 encounters the knife 84. While an inclination angle of about thirty degrees is suitable for the embodiment shown, lesser and greater inclination angles are foreseeable, as are lesser and greater angular spans for the circumferential opening 68. Furthermore, optimal outer and inner diameters of the impeller assembly 60 and casing 62, respectively, and radial extents of the paddles 74 may depend on the food product 96 to be processed. In an example in which the outer diameter of the impeller assembly 60 is roughly twenty inches (about 50 cm), the inner radial edge of each paddle 74 may be a radial distance of, for example, about two inches (about 5 cm) or more from the outer perimeter of the impeller assembly 60.

The apparatus 50 represented in FIGS. 2 through 4 can be adapted to cut a variety of different types of food products, and more particularly to cut food product while the food product still resides within the pockets between adjacent paddles 74. In the embodiment shown in FIGS. 2 through 4, a single knife 84 is shown centrally located within the circumferential opening 68 of the casing 62, with the result that the cut produced by the knife 84 essentially halves the product 96. However, the knife holders 86 and 88 are preferably adjustable to enable the position of the knife 84 to be adjusted relative to the circumferential opening 68 in directions parallel to the axis of the impeller assembly 60, such that cuts other than halving can be made in products as they are ejected by the impeller assembly 60 through the opening 68. It is also within the scope of the invention that more than one knife 84 could be held by the knife holders 86 and 88, such that multiple cuts can be simultaneously made through the food product 96.

While the invention has been described in terms of a specific embodiment, it is apparent that other forms could be adopted by one skilled in the art. For example, the physical configuration of the apparatus 50, its impeller assembly 60 and casing 62, and particular components of the apparatus 50 could differ from that shown, and various materials and processes could be used to manufacture the apparatus 50 and its components. Therefore, the scope of the invention is to be limited only by the following claims.

The invention claimed is:

1. An apparatus for cutting food product, the apparatus comprising:

a casing defining a stationary housing, the casing comprising an axial opening sized to accommodate a food product entering the casing, and comprising a circumferential opening sized to accommodate the food product exiting the casing;

an impeller rotatable within the casing about an axis of symmetry thereof, the impeller comprising a drum, paddles mounted to the drum, and pockets defined by and between adjacent pairs of the paddles, each of the paddles being associated with one of the pockets that is circumferentially ahead thereof in a direction of rotation of the impeller, the drum having an axial opening coinciding with the axial opening of the casing to define an inlet through which the food product enters the impeller, the paddles being circumferentially spaced along a perimeter of the drum so that each pocket is radially aligned with the circumferential opening of the casing to expel the food product within the pocket through the circumferential opening as the impeller rotates within the casing and the pocket travels past the circumferential opening of the casing, each paddle defining a planar surface for pushing the food product and having a relief slot defined in an outer radial edge of the paddle;

means for rotating the impeller within the casing to expel the food product through the circumferential opening as the impeller rotates within the casing and as each of the pockets travels past the circumferential opening of the casing; and a cutting device comprising at least a first knife disposed at the circumferential opening of the casing and having a cutting edge that is oriented perpendicular to the axis of symmetry of the impeller, the first knife being secured to the casing at oppositely-disposed ends of the first knife and defining a cord of the casing and having the cutting edge located within an interior of the casing so that the first knife extends into the path of the paddles, passes through the relief slots of the paddles, and cuts the food product expelled through the circumferential opening as the impeller rotates and the pockets pass across the circumferential opening in the casing;

wherein the planar surface of a first of the paddles is approximately perpendicular to the cutting edge of the first knife at the moment the first paddle has completed its pass across the circumferential opening of the casing.

2. The apparatus according to claim 1, wherein each of the paddles is inclined relative to radials of the impeller so that, for each of the paddles, an inner radial edge thereof is circumferentially ahead of the outer radial edge thereof in the rotational direction of the impeller.

3. The apparatus according to claim 1, wherein the first knife is the only cutting means of the cutting device disposed at the circumferential opening of the casing.

4. The apparatus according to claim 3, wherein the first knife is positioned at a central portion of the circumferential opening to halve the food product expelled from the casing through the circumferential opening.

5. The apparatus according to claim 1, wherein the first knife does not pass entirely through radial extents of the paddles defined between the outer radial edges of the paddles and corresponding inner radial edges of the paddles.

6. The apparatus according to claim 1, wherein the relief slots do not extend entirely through radial extents of the paddles defined between the outer radial edges of the paddles and corresponding inner radial edges of the paddles.

7. The apparatus according to claim 1, further comprising means downstream of the first knife for performing additional processing on the food product.

8. The apparatus according to claim 7, wherein the additional processing means comprises at least a second knife chosen from the group consisting of circular knives and crosscut knives.

9. A method of reducing the size of a plurality of food products using the apparatus according to claim 1, the method comprising:

providing the apparatus of claim 1; and introducing the plurality of the food products into the impeller and cutting the plurality of the food products with the first knife by rotating the impeller.

10. The method according to claim 9, wherein each individual food product of the plurality of the food products is cut and expelled from the casing during a single rotation of the impeller.

11. The method according to claim 9, wherein each paddle is parallel to the first knife at the moment the individual food product carried thereby encounters the first knife.

12. The method according to claim 9, wherein each paddle is perpendicular to the first knife at the moment the paddle has completed its pass across the circumferential opening of the casing.

13. The method according to claim 9, further comprising performing additional processing on the plurality of the food products downstream of the first knife.

14. A method of reducing the size of a plurality of food products using the apparatus according to claim 3, the method comprising:

providing the apparatus of claim 3; and introducing the plurality of the food products into the impeller and making a single cut through each individual food product of the plurality of the food products with the first knife by rotating the impeller.

15. The method according to claim 14, wherein each of the individual food products is cut and expelled from the casing during a single rotation of the impeller.

16. The method according to claim 14, wherein each paddle is parallel to the first knife at the moment the food product carried thereby encounters the first knife.

17. A method of reducing the size of a plurality of food products using the apparatus according to claim 4, the method comprising:

providing the apparatus of claim 4; and introducing the plurality of the food products into the impeller and halving each individual food product of the plurality of the food products with the first knife by rotating the impeller.

18. The method according to claim 17, wherein each of the individual food products is cut and expelled from the casing during a single rotation of the impeller.

19. The method according to claim 17, wherein each paddle is parallel to the first knife at the moment the food product carried thereby encounters the first knife.

* * * * *